United States Patent [19]

Takeuchi et al.

[11] 4,310,736

[45] Jan. 12, 1982

[54] VACUUM CIRCUIT INTERRUPTER

[75] Inventors: Koichi Takeuchi; Takeo Okada; Shinichi Aoki, all of Amagasaki, Japan

[73] Assignee: Mitsubishi Denki K.K., Tokyo, Japan

[21] Appl. No.: 610,397

[22] Filed: Sep. 4, 1975

Related U.S. Application Data

[63] Continuation of Ser. No. 444,348, Feb. 21, 1971, abandoned, which is a continuation-in-part of Ser. No. 184,207, Sep. 27, 1971, abandoned, and Ser. No. 184,597, Sep. 28, 1971, abandoned, which is a continuation-in-part of Ser. No. 808,263, Mar. 18, 1969, Pat. No. 3,668,350, which is a continuation of Ser. No. 805,221, Mar. 7, 1969, abandoned, said Ser. No. 184,207, is a continuation-in-part of Ser. No. 805,223, Mar. 7, 1969, abandoned.

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,082,307 | 3/1963 | Greenwood et al. | 200/144 B |
| 3,163,734 | 12/1964 | Lee | 200/144 B |
| 3,190,986 | 6/1965 | Jennings | 200/144 B |
| 3,231,704 | 1/1966 | Jacobs | 200/144 B |
| 3,246,979 | 4/1966 | Lafferty et al. | 200/144 B |
| 3,280,286 | 10/1966 | Ranheim | 200/144 B |
| 3,355,564 | 11/1967 | Ranheim | 200/144 B |
| 3,372,258 | 3/1968 | Porter | 200/144 B |
| 3,508,021 | 4/1970 | Bellis | 200/144 B |
| 3,555,222 | 1/1971 | Camacho | 200/144 B |
| 3,668,350 | 6/1972 | Takeuchi et al. | 200/144 B |

*Primary Examiner*—Robert S. Macon
*Attorney, Agent, or Firm*—Robert E. Burns; Emmanuel J. Lobato; Bruce L. Adams

[57] ABSTRACT

An arc extinguishing chamber confined by a cylindrical housing of stainless steel, and an insulating chamber within a hollow cylindrical insulator, communicate with each other and are maintained in a vacuum with two contacts formed of an electrically conductive material having lower melting and boiling points than copper disposed in the arc extinguishing chamber. A pair of apertured shield plates disposed respectively at each end of the housing and another pair of shield plates mounted respectively on each contact rod are formed of stainless steel. The housing and the shield plates prevent the extinguishing and insulating chambers from overheating during exhaustion at a high temperature and also from being contaminated in operation due to the vaporization of the contacts. Two heating devices are used to heat the housing to a higher temperature than the insulating chamber during the exhausting operation.

9 Claims, 11 Drawing Figures

VACUUM CIRCUIT INTERRUPTER

This application is a continuation of application Ser. No. 444,348, filed Feb. 21, 1974; which is a C-I-P of combined applications Ser. No. 184,207, filed Sept. 27, 1971 and Ser. No. 184,597, filed Sept. 28, 1971. Application Ser. No. 184,207 is a C-I-P of application Ser. No. 805,223, filed Mar. 7, 1969. application Ser. No. 184,597 is a C-I-P of application Ser. No. 808,263, filed Mar. 18, 1969 now U.S. Pat. No. 3,668,350; which is a continuation of application Ser. No. 805,221 filed Mar. 7, 1969.

All applications mentioned above except application Ser. No. 808,263 are now abandoned.

BACKGROUND OF THE INVENTION

This invention relates to a vacuum circuit interrupter of the type comprising a metallic housing defining an arc extinguishing chamber, a pair of contacts, one stationary and one movable, disposed in the housing, and at least on electrical insulating chamber secured to at least one end of the arc extinguishing chamber.

As all vacuum circuit interrupters are operated in a vacuum they can be expected to have the advantages including the following:

1. Their overall dimension is decreased because a very small distance of separation between the contacts permits the interrupter to withstand high voltages.

2. This decrease in dimension leads to both the simplification of the associated operating mechanism and an increase in the response speed thereof.

3. Because of the high speed at which ions produced during switching are diffused and extinguished immediately after an interruption of current flow, the interrupter is rapidly restored to its insulating state to withstand any restriking voltage, thus ensuring that it can rapidly and effectively interrupt a high current flowing therethrough while improving the reliability of the device.

4. Both of the contacts or electrodes are maintained in a clean state at all times and are capable of always engaging each other without oxidizing, thereby permitting a high current to readily flow therethrough. In addition, there is no fear that the interior of the exhausted vacuum envelope may be contaminated to deteriorate the capability of the interrupter. Thus a long useful life is ensured without any maintenance.

Vacuum circuit interrupters having the above cited advantages are described and claimed, for example, in U.S. Pat. Nos. 3,280,286, 3,231,705 and 3,082,307. The conventional vacuum circuit interrupters include an arc extinguishing chamber defined by a cylindrical metallic housing having a pair of contact members disposed therein, and an electrical insulator in the form of a hollow cylinder disposed at one or both ends of the housing. It has been a common practice in the production of such devices to heat both the arc extinguishing chamber and the insulator or insulators to the same temperature by a common heating device during the exhausting operation. On the other hand, during the operation of the vacuum circuit interrupters the components within the arc extinguishing chamber including the pair of contact members, that is to say, those portions contacting the so-called interrupting arc, are raised to the highest temperature as compared to the remaining portions of the device. Thus, it is desirable to heat those portions to a temperature substantially higher than the temperatures of the remaining portions of an interrupter or to a temperature equal to at least the said highest temperature during the exhausting operation while the latter operation is performed for a long interval of time until the interior of the interrupter reaches the desired high vacuum. Under these circumstances the insulator providing an electrical insulating chamber should be maintained at a temperature fairly lower than the temperature at which the above-mentioned portions are heated because of its low thermal resistance.

Furthermore, during the combined heating and exhausting operation and in the operation of vacuum circuit interrupters, a metallic vapor or vapors and scattered particles that may be formed within the arc extinguishing chamber can freely enter the associated insulating chamber to contaminate the latter. Also with the metallic housing heated to an elevated temperature, the insulating chamber can be also heated to an elevated temperature principally due to the thermal radiation from the housing. Practically, the metallic housing has been precluded from being heated to an elevated temperature above a temperature up to which the insulating chamber is allowed to be heated.

Additionally, in order to prevent an extraordinary voltage from occurring across the pair of contacts due to the chopping of a current upon interruption as well as to prevent the contacts from fusing to each other, it has been proposed to include a low melting-point metal such as bismuth, tellurium, antimony, silver or the like in the material for the contacts as disclosed in U.S. Pat. Nos. 2,975,255 and 3,246,979. Thus, if either or both of the contacts including a low melting-point metal is or are used in vacuum circuit interrupters, the metal can be readily evaporated when the associated arc extinguishing chamber has been heated to an elevated temperature and when an electric arc has been established across the contact member. When the housing and shields are formed of iron or nickel as in the prior art devices, the evaporated material adheres thereto and as a result the low melting-point metals are generally characterized as having a decreased ability to withstand voltages. Therefore in order to improve the characteristics of the prior art interrupters, it is highly desirable to select the material and construction of a housing providing an arc extinguishing chamber and shields so that the material is hardly affected with a vapor of such a low melting-point metal. This material should also have the desirable quality that it resists the deformation of the housing when it is subjected to a high vacuum at an elevated temperature. As a result the useful life of the interrupter will increase and the voltage characteristics will improve.

Interrupters having these improved qualities have not been previously put to practical use due to the following problems:

1. It has been found heretofore that stainless steel is unsuitable for effectively accomplishing the cooling of electric arcs, the condensation of metallic vapors and the sticking of particles spattered from the metallic material of the electric contacts. In order to enable the housing and/or arc shield to effectively accomplish the condensation and sticking respectively of the metallic vapor and spattered particles originating from the contact metal, the material of the housing has been considered preferably to have the following properties:

(a) it should be high in thermal conductivity; and (b) it should be the same as the material of the contacts.

Regarding the property (a), it is well known that for current interrupters high in interrupting current capacity, metals high in thermal conductivity are more suitable than electrically insulating materials such as glass and ceramics etc. This can readily be understood from the fact that the material of the housing and/or arc shield which is higher in thermal conductivity has a larger coefficient of condensation of metallic vapor resulting in the electric arc being more effectively cooled. Regarding the property (b), engineering principles with respect to evaporation teach that if the housing and/or arc shield is formed of a metal identical to that of the vapor thrown thereon from the associated contacts, its coefficient of condensation has a maximum value. The foregoing is applicable to the sticking of the spattered particles from the contact metal.

It is absolutely essential for vacuum circuit interrupters that the spattered metallic particles from the contact metal must rigidly adhere to the housing and/or arc shield during service. More specifically, vacuum circuit interrupters perform the switching operation through the impulsive engagement and disengagement of the movable contact with and from the stationary contact by the operation of the bellows involved. If the spattered metallic particles originating from the contacts do not rigidly adhere to the housing and/or arc shield, then the metallic particles thereon can peel off from the housing and/or arc shield due to the impulsion developed in the switching operation. This may lead to malfunctions wherein the contacts in their open position will be short-circuited. Furthermore, if the metallic particles do not adhere rigidly on the housing and/or arc shield, a disadvantage results in that the vacuum circuit interrupter deteriorates in its voltage withstanding property.

On the other hand, it has been generally practiced to use copper, as the base metal for contact materials, together with a low melting point metal(s) for the purpose of increasing the interrupting current capacity. Examples of the low melting point metal include bismuth, and tellurium, etc., and such metals serve to improve both the anti-fusion and the chopping current characteristic.

For the above reasons, the concept has prevailed that stainless steel is unsuitable for foming the housing and/or shield for vacuum circuit interrupters required to meet the conditions that (a) the material of the housing and/or arc shield be high in thermal conductivity; (b) the housing and/or arc shield should provide both a high coefficient of condensation of metallic vapor caused from the contact material and a surface upon which the spattered metallic particles can adhere rigidly; and (c) the contacts formed of copper, as the base metal, together with a low melting point metal(s) for example, bismuth or tellurium or the like. Therefore, vacuum circuit interrupters of the prior art type have comprised a housing and/or arc shield formed of copper, nickel, iron or the like. It is apparent that such metals are high in thermal conductivity, coefficient of condensation of metallic vapor and sticking force of spattered metallic particles, as compared with stainless steel.

(2) It has been believed that stainless steel is unsuitable for forming evacuated housings also serving as the arc-extinguishing compartments because such stainless steel is corroded when contacted by molten bismuth. This fact is the subject of the publication of the Proceedings of the International Conference on the Peaceful Uses of Atomic Energy, Vol. 9, entitled "Reactor Technology and Chemical Processing". Therefore stainless steel has been previously considered as impractical for use with the evacuated housing for vacuum circuit interrupters required to have a long useful life.

Thus, while vacuum circuit interrupters have been developed whose housings are made of stainless steel, which housings are evacuated to serve as arc-extinguishing compartments, those circuit interrupters have included special means for minimizing a thermal input to the housing and/or arc shield. For example, external coil or permanent magnet means have been necessarily used to establish a magnetic field coaxial with a flow of arcing current thereby to magnetically drive the electric arc so as to confine it as much as possible within a space formed between the opposed contacts, while at the same time metallic particles spattered from the contacts are prevented from reaching the outer peripheral portion around the contacts, that is, the housing and/or arc shield.

In other words, in the prior art, the formation of the housing and/or arc shield of stainless steel has been accompanied by the provision of means for establishing a magnetic field operative to prevent the particular metallic vapor from being scattered toward the housing and/or arc shield for the purpose of limiting the thermal input to the housing and/or arc shield to a certain magnitude. The provision of such additional means renders the resulting circuit interrupter excessively expensive, so that there has been a tendency to avoid the formation of the housing and/or arc shield of stainless steel. To this end, the arc-extinguishing compartment has been heretofore formed of any suitable electrical insulating material. Alternatively, if it is required to be formed of a metallic material, iron or copper has been mainly used. In addition to the tendency to avoid the formation of the housing and/or arc shield of stainless steel as above described, the idea has never been expressed that the electric contacts should include a low melting point metal used in conjunction with the arc-extinguishing compartment formed of stainless steel.

However, applicants have found that low melting point metals such as bismuth, at temperatures above approximately 400° C., do not adhere rigidly to stainless steel. Also, applicants have found that even at relatively high temperatures, stainless steel is higher in mechanical strength than iron and copper thus permitting the housing to be actually heated at a temperature of from 450° to 900° C. and evacuated and that it is advantageous in that its weldability is good, while providing good anti-fusion and chopping current characteristics.

As a result of experiments it has been found that in vacuum circuit interrupters comprising the combination of a housing and/or arc shield formed of stainless steel, and electric contacts including a low melting point metal, the above-mentioned disadvantages have been negligible for all practical purposes and therefore the interrupters can be satisfactorily put to practical use. More specifically, with the housing or arc shield formed of stainless steel, heavy currents whose magnitude exceeded 40 KA were successfully interrupted by properly selecting the thickness of the stainless steel its diameter relative to that of the contact, its surface roughness and means for cleaning its surface, etc. Furthermore, it has been found that when the housing and/or arc shield are roughly polished, the adherence of the spattered metal on the housing and/or arc shield has been improved to such an extent that the sticking force has not caused any practical problems.

With the contacts including copper as the base metal, practical experiments have been conducted in terms of the corrosion of stainless steel effected with a small amount of melted bismuth present in the copper, due to the melted metallic particles spattered from the contacts and stuck to the housing and/or arc shield. The results of the experiments indicate that the portion of bismuth dissolved or penetrated into the stainless steel is substantially negligible.

During the manufacture of vacuum circuit interrupters the housing and/or arc shield of stainless steel is subjected to heating, evacuation, and outgassing processes, by which a low melting point metal such as bismuth, tellurium or the like contained in the contacts may be heated and evaporated. It has been found that the evaporated portion of bismuth is not readily deposited on a housing and/or arc shield made of stainless steel. Therefore, it is very difficult for the stainless steel to become corroded with bismuth. Furthermore, the housing and/or arc shield of stainless steel are excellent in voltage withstanding properties.

SUMMARY OF THE INVENTION

Accordingly it is an object of the invention to provide a new and improved vacuum circuit interrupter including a hollow electrical insulator and a metallic housing providing an arc extinguishing chamber communicating with the interior of the insulator and capable of being heated to an elevated temperature to be exhausted to a high vacuum, thereby to increase the reliability of the interrupter.

It is another object of the invention to provide a vacuum circuit interrupter of the type as described in the preceding paragraph including inproved shield means having shield members formed of stainless steel for protecting the electrical insulator against heat generated in the arc extinguishing chamber during the combined heating and exhausting operation, and for shielding the electrical insulator from an electric arc struck in the chamber in the operation of the interrupter.

It is a still another object of the invention to provide a relationship between an outside diameter of a metallic housing of a vacuum circuit interrupter and its wall thickness to permit the interrupter to be exhausted to a higher vacuum at an elevated temperature, thus leading to a further increase in reliability.

It is a still further object of the invention to provide a new and improved vacuum circuit interrupter including a pair of engageable contacts containing a low melting-point metal and disposed in a metallic housing formed of stainless steel which is capable of being heated to an elevated temperature and exhausted to a high vacuum thereby to improve the reliability of the interrupter as well as its ability to withstand high voltages.

It is still another object of the invention to provide a vacuum circuit interrupter including improved means for preventing the surrounding air from deforming the metallic housing when it is subjected internally to a high vacuum at an elevated temperature.

It is a further object of the invention to provide improved apparatus for a method of heating a vacuum circuit interrupter of the type described in the preceding paragraph such that the metallic housing is heated to an elevated temperature to be exhausted to a very high vacuum while the insulation is maintained at or below the maximum permissible temperature thereof.

The invention accomplishes the above-cited objects by the provision of a vacuum circuit interrupter, comprising a pair of switching contact members, and a metallic housing formed of stainless steel having the pair of contact members disposed therein and providing an arc extinguishing chamber characterized in that the metallic housing has disposed, at least at one end an electrical insulator in the form of a hollow cylinder to form an exhausted envelope, and shield means comprising shield plate formed of stainless steel are disposed within the arc extinguishing chamber to prevent overheating of the electrical insulator during the combined heating and exhausting operation and to protect the electrical insulator against an electric arc struck in the arc extinguishing chamber.

At least one of the contact members includes a low melting-point metal such as copper, as a base metal, together with a metal which is lower in melting and boiling points and higher in vapor pressure than copper.

The stainless steel may advantageously be a non-magnetic stainless steel of austenitic structure consisting of at least 10% by weight of chromium, at least one 6% by weight of nickel and the balance iron except for very small amounts of incident impurities.

In order to prevent the cylindrical housing formed of the non-magnetic stainless steel as above described from being deformed, when in a heated and exhausted state, by the action of an external force such as the pressure of the surrounding air, the housing may have an outside diameter D in mm, and thickness T in mm, satisfying the relationship:

$$T \geqq 0.8 \frac{D}{100^2} \cdot (D - 20) - 1$$

where T has a minimum magnitude of 0.5 mm, and where D is replaced by 240 when the outside diameter has a magnitude exceeding 240 mm.

The stainless steel may advantageously be a non-magnetic stainless steel of austenitic structure consisting of at least 10% by weight of chromium, at least 6% by weight of nickel and the balance iron except for very small amounts of incidental impurities.

In a preferred embodiment of the invention, the vacuum circuit interrupter may comprise a pair of switching contact members formed of electrically conductive material having lower melting and boiling points than copper, two rods of electrically conductive material having the contact members carried respectively at their one ends, a cylindrical housing of stainless steel providing an arc extinguishing chamber and having the pair of contact members disposed therein, an apertured metallic plate fitted into at least one end of the cylindrical housing and welded to that end, an electrical insulator in the form of a hollow cylinder closed at one end and secured at the other end to the end plate, and an apertured shield plate of stainless steel secured to the end plate on that side facing the arc extinguishing chamber and having the contact rod loosely extending therethrough to form a gap therebetween substantially equal to a minimum distance corresponding to a predetermined voltage which the interrupter must withstand.

Furthermore, another shield plate of stainless steel may be advantageously mounted on that portion of the rod disposed in the arc extinguishing chamber with a gap between the outer periphery and the adjacent portion of the cylindrical housing substantially equal to a minimum distance corresponding to a predetermined voltage which the interrupter must withstand.

In order to heat the vacuum circuit interrupters, as above described, for exhausting purposes, the invention provides a heating apparatus including first heating means for heating at least the electrical insulation, and second heating means for heating only the metallic housing to a temperature higher than a temperature to which the insulation is heated.

BRIEF DESCRIPTION OF THE DRAWING

The invention will become more readily apparent from the following detailed description taken in conjunction with the accompanying drawings, in which.

Throughout the FIGURES like reference numerals designate the corresponding or similar components.

DESCRIPTION OF THE PREFERRED EMBODIMENTS

Figure 1:
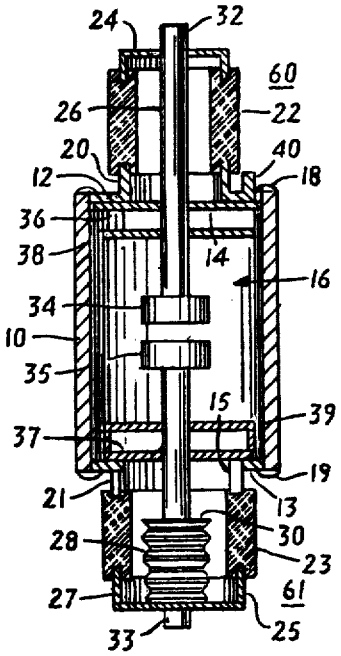
FIG. 1 is an elevational view, partly in longitudinal section of a vacuum circuit interrupter constructed in accordance with the principles of the invention.

Referring now to the drawings and in particular to FIG. 1, it is seen that the arrangement disclosed herein comprises a circularly cylindrical housing 10 of any suitable metallic material having a pair of end plates 12 and 13 of any suitable metallic material each said end plate including a central aperture 1 and 15, respectively, and being closely fitted into an opposing end of the cylindrical housing 10 to form an arc extinguishing chamber generally designated by the reference numeral 16. The housing 10 is preferably formed of stainless steel. The end plates 12 and 13 are preferably formed of the same material as the housing 10 and have a relatively large thickness and an outer surface substantially flush with the respective end faces of the housing 10. The end plates 12 and 13 are then welded at their outer peripheral edges to the adjacent ends of the housing 10, respectively, thus ensuring a vacuum tight relationship between the housing and each of the end plates. Metallic collars 20 and 21 each have one end portion fitted in vacuum tight relationship into the central aperture 14 and 15 on the end plates 12 and 13 respectively and the other end connected in vacuum tight relationship to one end of respective electrical insulators 22 and 23 in the form of hollow cylinders. The insulators 22 and 23 may be composed of any suitable electrical insulating material such as glass or ceramic. The end plates 12, 13 and collars 22, 21 disposed between the hollow cylinder 10 and the insulators 22 and 23 serve to increase the distance between the hollow cylinder 10 and each insulator 22 or 23, thereby increasing the thermal resistance occurring therebetween, and hence the area of heat dissipation. This function is more effective when the components 12, 13, 20 and 21 are formed of a relatively thin metallic material such as stainless steel which is high in thermal resistance. Apertured metallic covers 24 and 25 in the form of cups are connected in vacuum tight relationship to the other ends of the insulators 22 and 23 with their mouths facing the associated insulator. The collars and covers are preferably of any suitable metallic material approximating in its coefficient of thermal expansion the material for the insulators and may be conveniently united with the respective insulators during the moulding of the latter. The metallic collars, the insulators and the metallic covers are disposed coaxially with one another and with the housing 10 to form at both ends of the latter or of the arc extinguishing chamber 16 a pair of electrical insulating chambers communicating therewith and generally designated by the reference numerals 26 and 27 respectively. Furthermore, the components 10, 12, 13, 20, 21, 22, 23, 24 and 25 form a closed envelope to be exhausted.

As shown in FIG. 1, a metallic bellows 28 has one end fixed in vacuum tight relationship to one of the covers, in this example, the lower cover 25 and the other end extending into the associated insulator 23 and closed by a metallic end plate 30.

A stationary rod 32 of any suitable electrically conductive material is centrally extended and sealed through the upper cover 24 and then extended in coaxial relationship through the insulating chamber 26 until it reaches substantially the middle portion of arc extinguishing chamber 16. The stationary rod 32 has a stationary contact member 34 carried at the free end located in the chamber 16. Similarly, a movable rod 33 of the same material as the stationary rod 32 centrally extends through the bellows and lower insulating chamber 28 and 27 respectively into the arc extinguishing chamber 16 with the movable rod sealed through the end plate 30 of the bellows. Within the arc extinguishing chamber 16, the movable rod 33 is precisely aligned with the stationary rod 32 and has carried at the free end a movable contact member 35 facing the stationary contact member 34 with a gap formed therebetween. In this way the contact members 34 and 35 are approximately centrally disposed within the arc extinguishing chamber 16. The contacts 34 and 35 may be preferably of an electrically conductive material having lower melting and boiling points than copper and vaporizable during exhaustion and arcing.

According to one aspect of the invention, a partition or first shield member 36 of stainless steel in the form of an annulus is fixedly secured to the inner surface of the upper end plate 12 as by welding or brazing and a second shield member 38 of stainless steel in the form of a disc is preferably fixedly mounted on the stationary rod 32 between the first member 36 and the stationary contact member 34 for the purpose as will be apparent hereinafter. Members 37 and 39 identical to the members 36 and 38 are operatively associated with the lower end plate and movable rod 13 and 33 respectively in the same manner as the members 36 and 38. The second shield members 38 and 39 each have an outside diameter larger than both the diameter of the associated central aperture 14 or 15 on the endplates 12 and 13 and the inside diameter of the associated insulators 22 and 23, while the central apertures 14 and 15 each have a diameter smaller than the inside diameter of the associated insulators 22 and 23. Both the contact rods 32 and 33 loosely extend through the respective apertures on the first shield members 36 and 37 to form gaps therebetween.

In order to exhaust the chambers 16, 26 and 27 an exhaust tube 44 is extended and sealed through one of the end plates, in the illustrated example, the upper end plate 12.

After the arrangement has been exhausted through the exhaust tube 44 followed by the closure of the tube, an operating mechanism (not shown) can be operated to move the movable contact rod 33 toward and away from the stationary contact rod 32 to put the movable contact 35 in engagement with and in disengagement from the stationary contact 34 respectively.

The arc extinguishing chamber 16 provides a space serving to permit the expansion of an electric arc struck between the contact members 34 and 35 upon interrupting a current flowing through the interrupter, and also to rapidly diffuse and extinguish ions caused from the electric arc and left along the arc path after the current has reduced to zero, whereby the dielectric strength of the chamber is rapidly restored to complete the interrupting operation. Thus, it will be appreciated that the arc extinguishing chamber is an essential component governing the interrupting function of the vacuum circuit interrupter.

Also, the insulating chambers 26 and 27 and particularly the insulators 22 and 23 function to maintain the separated contact members 34 and 35 in an electrically insulated state. Therefore, each of the insulators 22 and 23 is designed and constructed so as to have a physical dimension providing a dielectric strength sufficient to withstand any high voltage applied across the contact members 34 and 35 by the associated electric circuit.

It is well-known that, in order to exhaust vacuum circuit interrupters to a high vacuum to increase the interrupting capability thereof, it is required to heat the components of the interrupter to an elevated temperature sufficient to liberate gases and/or vapors absorbed or occluded by the components during the exhausting operation. On the other hand, the components defining the arc extinguishing chamber 16 along with the contact members 34 and 35 may contact the so-called interrupting arc to be raised to a maximum possible temperature higher than the temperatures of the remaining portions of the interrupter in operation. Therefore the components defining the arc extinguishing chamber along with the contact members are required to be heated to or above a maximum temperature encountered in operation while the interrupter is exhausted for a long interval of time sufficient to obtain a desired high vacuum. This leads to the necessity of using metallic materials capable of withstanding such an elevated temperature for a long interval of time for the housing 10 and the associated members forming the arc extinguishing chamber. That is, the materials for housing member 10 and preferably for the end plates 12 and 13 should be high in thermal resistance and low in their gas permeability and susceptibility to oxidation at elevated temperatures.

It has been determined that the housing 10 formed of stainless steel can be maintained in its exhausted state at an elevated temperature for a long interval of time. It has been found also that in an atmosphere of a vacuum, even when heated to redness, stainless steels are high in mechanical strengths, and very low in oxidation susceptibility, while permitting only a very small amount of any gas to pass therethrough. Thus, the housing 10 formed of stainless steel is allowed to be exhausted to a high vacuum at an elevated temperature for a long interval of time. Furthermore, it has been found that the optimum material for the housing 10 is a non-magnetic stainless steel of austenitic structure consisting of at least 10% by weight of chromium, at least 6% by weight of nickel and the balance, iron except for very small amounts of incidental impurities.

Recently, there has been the tendency to use electric contacts including a low melting-point metal such as bismuth, tellurium, antimony, silver or the like in vacuum circuit interrupters in order to prevent an extraordinary voltage from occurring across the contacts due to the chopping of a current upon interruption, and to prevent the contacts from fusing to each other as previously pointed out. Reference may be made to U.S. Pat. Nos. 2,975,255 and 3,246,979. The low melting-point metals are characterized in that they have lower melting and boiling points and higher vapor pressure than copper. Under these circumstances, the particular low melting-point metal included in either or both of the contacts is evaporated to provide a high vapor pressure when the contacts are heated to an elevated temperature during the combined heating and exhausting operation and/or when an electric arc is established thereacross. Such metals when evaporated are generally apt to adhere to iron, nickel etc. and are also low in their ability to withstand voltage. Therefore, if such a low melting-point metal has adhered to any portion or portions of the housing member 10 and associated members such as the shield members 36, 37, 38 and 39, then this leads to a decrease in the allowable voltage under which the contact members 34 and 35 and therefore the contact rods 32 and 33 can be maintained in an electrically insulated condition from such a portion or portions having the vaporized metal deposited thereon.

To avoid that trouble, we have conducted many experiments with various metals under the same conditions in order to determine the adherence characteristics of low melting point metals and metals which would resist the adherence of such low melting-point metals. The results thereof are listed in the following Table I.

TABLE I

| | Non-magnetic stainless steel | Weak magnetic stainless steel | Kovar alloy | Pure nickel | Pure iron | Carbon steel | Pure copper |
|---|---|---|---|---|---|---|---|
| Bismuth | 1 | 2 | 30 | 70 | 60 | 50 | 40 |
| Tellurium | 1 | 2 | 30 | 50 | 60 | 50 | 70 |

In Table I the thicknesses of bismuth or tellurium films adhering to the metals are expressed by relative magnitudes, assuming that the film adhered to the non-magnetic stainless steel as above specified is one unit thick. From Table I it is seen that bismuth and tellurium do not adhere readily to stainless steels. This is true in the case of low melting-point metals other than bismuth and tellurium. The result of experiments also indicated that the housing 10 formed of stainless steel has an inner surface characterized by high resistance to the chemical action of any vaporized metal even under its vapor pressure increased at an elevated temperature, and by low contamination with the particular low melting-point metal vaporized from either or both of the associated contacts even in a high vapor pressure thereof, thus preventing a reduction in the ability of the interrupter to withstand voltage and a deterioration of the interruption characteristics.

A breakdown voltage between two metallic electrodes disposed in opposite relationship in the vacuum is greatly dependent upon the material for the electrodes. Stainless steel and tungsten are high in breakdown voltage and suitable for use in vacuum type circuit interrupters withstanding high voltages. On the other hand, low melting-point metals such as bismuth are low in breakdown voltage and are generally considered to be unsuitable for use in vacuum type circuit interrupters required to withstand high voltages.

However, vacuum type circuit interrupters must be excellent in their capability for chopping current, and for withstanding high voltages. For this reason bismuth can be used with a greater part of such circuit interrupters. With the main electrodes formed of an alloy containing bismuth it is required to render the breakdown voltage between the main electrodes equal to a minimum value to cause the discharge current to flow through them while preventing the breakdown between those portions other than the main electrodes and particularly between metallic shields etc. and on the outer metallic enclosure, that is to say, preventing the discharge current from flowing toward the shields etc, and the enclosure.

In order to determine the effect of the evaporation of bismuth upon breakdown voltages in a vacuum, the applicants conducted many experiments wherein electrodes or compared samples were formed of a metallic material selected from the group consisting of stainless steel, Kovar alloy, Nickel, carbon steel and copper, and disposed in opposite relationship with an outer enclosure having a peripheral wall made of glass. The experiments were conducted with the vacuum tube having another electrode of a copper alloy containing bismuth disposed therein, and a similar tube not having such an electrode of Cu-Bi alloy disposed therein. The tubes were evacuated while they were backed out at 450° C. After the completion of the evacuation, the breakdown voltage between the opposite electrodes was measured.

The results of the experiments are listed in the following TABLE II.

TABLE II

| | Stainless steel | Kovar alloy | Pure nickel | Pure iron | Carbon steel | Pure copper |
|---|---|---|---|---|---|---|
| Interrupter Breakdown voltage without Cu—Bi alloy disposed in tube | 80kV | 78kV | 75kV | 78kV | 76kV | 72kV |
| Interrupter Breakdown voltage with Cu—Bi alloy disposed in tube | 78kV | 54kV | 45kV | 46kV | 48kV | 52kV |

From the above Table it is seen that the breakdown voltage between the electrodes of stainless steel is high even in the case Cu-Bi alloy is contained in the tube.

The present invention has been embodied into circuit interrupters which exhibit a very excellent performance. That is, the conventional circuit interrupters of the type referred to have been able to operate with voltages in the order of from 3 to 6 Kilovolts whereas circuit interrupters embodying the principles of the present invention have been able to operate with voltages in the order of from 20 to 30 kilovolts with the outside diameter and overall length remaining unchanged.

Therefore, the housing 10 should be composed of stainless steel and preferably of the non-magnetic stainless steel of austenitic structure as above specified while the end plates 12 and 13 are preferably composed of the same type of stainless steel as the housing. Under these circumstances, either or both of the contact members 34 and 35 can have copper as a base material and include a low melting-point metal such as above described without a fear that the inner wall of the arc extinguishing chamber 16 will be contaminated with such a metal evolved from the contact members.

Since the shield members 36 through 39 are exposed to elevated temperatures and metallic vapors evolved in the arc extinguishing chamber in the combined heating operation and in the operation of the interrupter, they must be formed of stainless steel and preferably of a non-magnetic stainless steel of austenitic structure as previously described for the same reasons as previously described in conjunction with the material for the housing 10. The shield members 36 through 39 function to shield the associated insulation 22 or 23 or insulating chamber 26 or 27 from thermal radiation originating from the arc extinguishing chamber 16 to prevent any metallic vapor evolved in the chamber 16 from entering the insulating chamber 26 or 27. To this end, a distance between each of the first shield members 36 or 37 and the associated contact rod 32 or 33 must provide the ability to withstand voltages as required for the interrupter. Also, at least one of the distances between each of the first shield members 36 and 37 and the associated second shield member 38 or 39 and between each of the second members and the adjacent portion of the cylindrical housing 10 must also provide the ability to withstand voltages as required for the interrupter. Moreover, such distances are required to be as small as possible. Further it is more effective to dispose the first and second shield members within the arc extinguishing chamber 16. Also, separators 37 and 37 function to permit the hollow cylinder 10 to be heated to a higher temperature than the subassemblies 60 and 61 during the exhausting procedure dicussed with respect to FIG. 7.

In vacuum type circuit interrupters having an electric contact which includes a low melting point or high vapor pressure metal as compared to copper, the vapor of such metallic material evolved during the interrupting operation will deposit on various portions of the interior of the interrupter. If such a vapor becomes deposited on internal surfaces of insulators such as designated 22 and 23 in the present specification then the effectiveness of the insulators deteriorates because the low melting-point metals provide an inherently low withstanding voltage. On the other hand, it is not desirable to heat the subassemblies including the insulators 22 and 23 to the same elevated temperature as the metallic hollow cylinder, since the latter must be subjected to as much heat as possible to effectively drive off the impurities contained in the contacts. To this end, it becomes required to restrict the heat applied to the insulators.

The present invention contemplates to eliminate the necessity of using separate heaters by the provision of the separators 36 or 37 for preventing the cylinder heated at a higher temperature from transferring the heat of radiation therefrom to the subassembly. More specifically, if the subassembly is not shielded from the heat of radiation caused from the heated cylinder, then heating the hollow cylinder alone to a higher temperature is necessarily accompanied by the subassembly having been also heated to a high temperature due to the heat of radiation. However, while the separators serve to shield the subassembly from the heat of radiation they also appreciably decrease the distance between the separator and the adjacent component such as the electrode shaft 32 or 33 shown in the drawings of the present specification, so that a breakdown is apt to occur between the separator and the adjacent component. It has been found on the other hand, however, that low melting point metals such as Bismuth and Tellurium do not adhere readily to stainless steel, as described above, so that the risk of voltage breakdown is negligible.

It will be readily understood that the housing 10 composed of stainless steel may decrease in mechanical strengths and increase in gas permeability at elevated temperatures. In order to prevent the stainless steel housing from being deformed by the action of a compressive force externally applied thereto during the combined heating and exhausting operation, while maintaining the interior of the housing in a high vacuum as required, it is necessary to render the thickness of the housing larger than a certain limit. As a result of experiments on vacuum circuit interrupters such as previously described having different dimensions, it has been concluded that the housing 10 must have a thickness equal to or greater than 0.5 mm for the small-sized interrupters while the greater the outside diameter of the housing the larger should be a ratio of thickness to outside diameter. If the non-magnetic stainless steel of austenitic structure as previously specified is used to form the housing it has been found that the thickness T in mm and the outside diameter D in mm must hold the following relationship $$T \geqq \frac{D}{100} + 0.8\frac{D}{100^2}(D - 20).$$

Further, it has been found that even by taking into account permissible changes in type of stainless steel, heating time, heating temperature, degree of vacuum of the housing 10 etc, the thickness is required always to hold the relationship $$T \geqq \frac{D}{100} + 0.8\frac{D}{100^2}(D - 20) - \left(1 + \frac{D}{100}\right), \quad (2)$$

or, $$T \geqq 0.8\frac{D}{100^2}(D - 20) - 1. \quad (3)$$

In addition, it has been determined that if the outside diameter D is eqqal to or greater than 240 mm, D in each of the relationships (1), (2) and (3) should be replaced by a value of 240. Further, it has been found that an increase in thickness of the housing 10 above a certain limit causes an increase in cooling effect and therefore improvements in the interrupting capability of the resulting vacuum circuit interrupter.

It is important that the longitudinal axes of the stationary and movable contact rods 32 and 33 respectively, are precisely aligned with each other and that the stationary and movable contact members 34 and 35 respectively, have their opposing surfaces maintained in an exact parallel relationship, while these aligned and parallel relationships are effectively prevented from breaking down due to any deformation of the housing 10 that may occur during the welding operation and during the combined heating and exhausting operation. To this end, the internal surfaces of both end portions of the housing 10 are preliminarily mechanically formed to have their longitudinal axes precisely aligned with each other, and the end plates 12 and 13 are closely fitted into the formed end portions of the housing. The outer peripheral edges of the end plates are preferably substantially flush with the adjacent ends of the housing. Then the edges of the end plates are welded to the respective ends of the housing 10.

This measure ensures that the longitudinal axes of the internal cylindrical end surfaces of the housing 10 are precisely aligned with each other while the end portions of the housing 10 are free from any deformation that may occur during the succeeding welding operation for the reason that the end plates are closely fitted into the ends of the housing. Also, when the housing is heated to an elevated temperature thereby softening during the exhausting operation, each of the end plates 12 and 13 supports its associated end of the housing 10 whereby the outer peripheral surface of the end plate bears the pressure of the ambient air applied externally to the housing. Thus, the end plates 12 and 13 serve to reinforce the housing 10 preventing any deformation thereof. As a result, the interior of the housing 10 can be heated to a higher temperature for exhaustion to a high vacuum.

In operation, the longitudinal axes of the stationary and movable contact rods 32 and 33 respectively are also precisely aligned with each other while at the same time the stationary and movable contact members 34 and 35 can be in good engagement with each other under a surface pressure uniformly distributed over the entire contacting surfaces thereof with the result that both the contact members 34 and 35 are prevented from fusing to each other. The addition of a low melting-point metal to at least one of the contact members aids in preventing this fusing to the contact-members. Furthermore, the bellows 28 is prevented from having a force applied along its longitudinal axis, which force would decrease its useful life. Also, attendant advantages are realized in that the assembling operation is performed in an easy and rapid manner.

Figure 2:
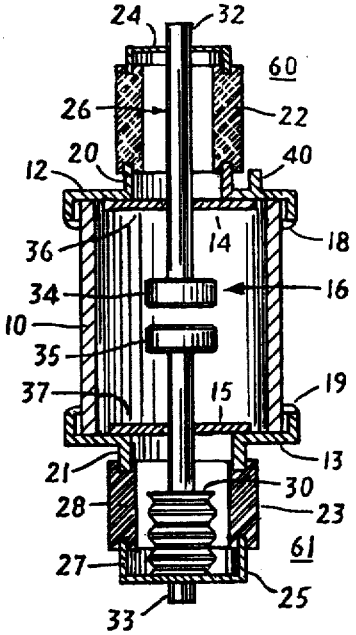
FIG. 2 is a view similar to FIG. 1 but illustrating a modification of the invention.

Referring now to FIG. 2, it is seen that first shield members 36 and 37, similar to those shown in FIG. 1, are fixedly secured to each of cup-shaped end plates 12 and 13 at the inner bottom as by welding or brazing. The end plates 12 and 13 have a diameter somewhat greater than the outside diameter of the housing 10 and cover each end of the cylindrical housing 10 and have short cylindrical portions 42 and 43 respectively with the mouth edges of the plates welded to the adjacent portions of the housing by welded joints 18 and 19. In other respects the arrangement is identical to that illustrated in FIG. 1 except that the second shield members are omitted.

Figure 3:
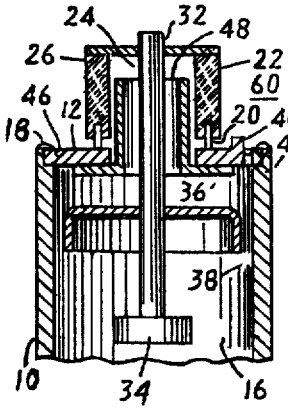
FIG. 3 is a fragmental elevational view, partly in longitudinal section of another modification of the invention illustrating a stationary contact member and the associated components.

In FIG. 3, the housing 10 is provided at one end, for example the upper end, with an inner peripheral recess 44. Then, closely fitted into the enlarged end of the recess 44 is an apertured end plate 12 having an annular groove on the exposed surface and an annular ridge 46 disposed outside the groove on the same surface and contacted on the outer peripheral side by the internal surface of the end portion of the housing 10, with the extremity of the ridge substantially flush with the end of the housing. The ridge 46 is sealed at the extremity to the end of the housing 10 by a welded joint 18.

If desired, a lower end plate similar in configuration to the upper end plate as above described may be operatively connected to the lower end, complementary in configuration to the end plate of the housing.

A portion of a first shield member 36 fixed to the end plate 12 includes a hollow cylindrical portion 52 projecting into the associated insulating chamber 26 closed with a flat cover 24. A second shield member 38 in the form of a cup is mounted on stationary rod 32 with the mouth of the cup directed to a stationary contact member 34. In other respects the arrangement is identical to the corresponding portion of the arrangement as illustrated in FIG. 1.

Figure 4:
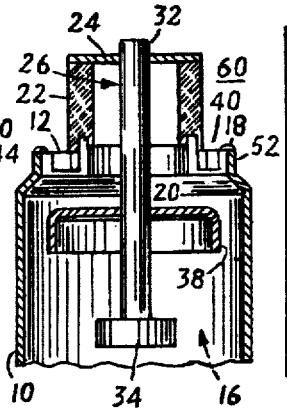
FIG. 4 is a fragmental elevational view, partly in longitudinal section of still another modification of the invention illustrating a movable contact member and the associated components.

An arrangement shown in FIG. 4 includes a housing 10 having an upper end portion 52 reduced in diameter into which an apertured end plate 12 in the form of a shallow cup is closely fitted with its bottom facing the interior of the housing. The end plate 12 is welded at the mouth edge to the reduced end of the housing 10 by a welded joint 18 bridging the end of the housing and the edge of the plate substantially flush therewith. The end plate 12, however, does not have a first shield member attached thereto. In other respects the arrangement is similar to that illustrated in FIG. 3.

Alternatively, the end portion of the housing may be enlarged in diameter.

It is to be noted that the shield member has at least one portion extending radially of the longitudinal axis of the cylindrical housing 10, unlike the conventional type of vacuum circuit interrupters including a shield member concentric with the associated exhausted housing.

Figure 5:
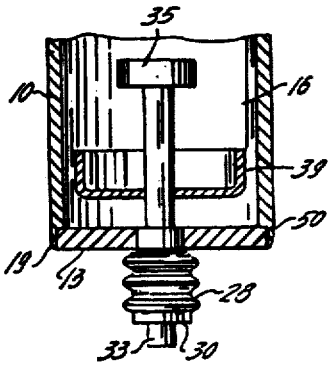
FIG. 5 is a fragmental elevational view, partly in longitudinal section of another modification of the invention illustrating a movable contact and the associated components.

FIG. 5 shows another form of the end plate. The end plate designated by the reference numeral 13 having a bevelled peripheral surface 50 is closely fitted into a lower end portion complementary in configuration to the end plate of a housing 10 and welded at 19. The end plate 13 has centrally extended and sealed therethrough a bellows 28 with the inner end face substantially flush with the internal surface of the end plate. A movable rod 38 is extended and sealed in vacuum tight relationship through the exposed end of the bellows 28 and loosely extended through the inner end thereof, with a movable contact member 35 attached to the rod 33 at the free end. A second shield member 39 in the form of a cup is mounted on the contact rod 33 and has a mouth opposite to the movable contact member 35.

Figure 6:
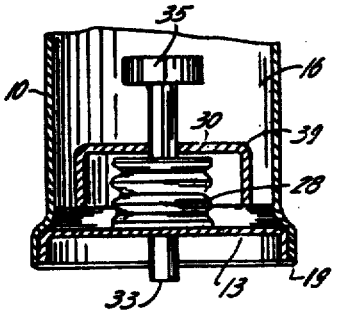
FIG. 6 is a view similar to FIG. 5 but illustrating a different modification of the invention.

In FIG. 6, the housing 10 has a lower end portion 54, enlarged in diameter, in which an end plate 13 in the form of a shallow cup is closely fitted in an upside-down relationship. The end plate 13 is connected in a vacuum tight relationship to the end of the housing 10 by a welded joint 19 similar to the welded joint 18 as shown in FIG. 5. A bellows 28 is connected at one end to the lower end plate 13 in a vacuum tight relationship. A movable contact rod 36 is extended and sealed through the other end of the bellows and has a second shield member 39 in the form of a cup mounted thereon so as to embrace the bellows 28. The rod 36 is provided at its free end with a movable contact member 35.

In the arrangements as shown in FIGS. 1 through 6 it is to be noted that the end plate engages the adjacent end portion of the housing 10 over a relatively large area in the axial direction of the housing 10 for the purpose of reinforcing the latter as previously described.

The vacuum circuit interrupter according to the invention may be assembled in the manner as will be subsequently described with reference to FIG. 1.

The stationary contact member 34, the stationary rod 32, the second shield member 38, the first shield member 36, the end plate 12 with the exhaust tube 40, the metallic collar 20, the insulator 22 and the cup-shaped cover 24 are first connected to one another to form a stationary subassembly generally designated by reference numeral 60. The longitudinal axis of the outer periphery of the end plate 12 is maintained in a precisely aligned relationship with respect to the longitudinal axis of the rod 32, and also exactly at right angles to the contact surface of the stationary contact member 34 as previously described. The corresponding components associated with the movable contact member 35 are similarly connected to one another to form a movable subsassembly generally designated by the reference numeral 61. Also the longitudinal axis of the outer periphery of the end plate 13 is maintained in precisely aligned relationship with respect to the longitudinal axis of the movable rod 33, and exactly at right angles to the contacting surface of the movable contact member 35.

Then the subassemblies 60 and 61 are united with the housing 10 by having the end plates 12 and 13 closely fitted into the both end portions of the housing 10 with the outer peripheral edge of each plate substantially flush with the adjacent end of the housing. Those end portions have the respective internal surfaces preliminarily machined to have their longitudinal axes precisely aligned with each other and with the longitudinal axis of the housing 10. Then the end plates 12 and 13 are welded in a vacuum tight relationship to the ends of the housing 10 at 18 and 19 respectively.

Thus it will be appreciated that the interrupter as assembled includes the stationary and movable rods 32 and 33 having their longitudinal axes precisely aligned with each other and with the longitudinal axis of the housing 10, while at the same time the opposing surfaces of the contact members 34 and 35 are exactly parallel to each other and precisely at right angles to the common longitudinal axes of both the rods 32 and 33. In other words, both the contact members are exactly centered with each other and can engage each other with a surface pressure uniformly distributed over the entire contacting surfaces thereof. Also, the end plates 12 and 13 closely fitted into the adjacent ends of the housing 10 are effective for preventing the latter from being deformed due to heat generated by the welding operation.

On the contrary, if an upside-down cup-shaped end plate is welded on the mouth of the housing 10 at an axial distance somewhat separated from the corresponding end of the housing as in the arrangement shown in FIG. 2, heat due to the welding may deform the housing. Furthermore, during the succeeding exhausting operation performed at an elevated temperature the housing may be softened and appreciably deformed because it includes no insert such as the end plate which is capable of opposing an external force such as the pressure of the surrounding air applied thereto. Such deformation may lead to an error in relative positions of the stationary and movable subassemblies 60 and 61. Therefore, in the arrangement as shown in FIG. 2, that portion of the end portion superposing the housing is preferably as short as possible.

In order to improve the accuracy with which the subassemblies 60 and 61 are assembled in the housing 10, the internal cylindrical surfaces of at least both end portions of the housing are preferably, formed for example by machining, to have their longitudinal axes precisely aligned with each other. FIGS. 1, 3 and 5 show the housings having been subjected to such machining operation. The arrangement of FIG. 4 includes the housing 10 having one end portion 52 reduced to a smaller diameter, while the arrangement of FIG. 6 includes the housing having one end portion 54 enlarged to a greater diameter for the same purpose.

Figure 7:
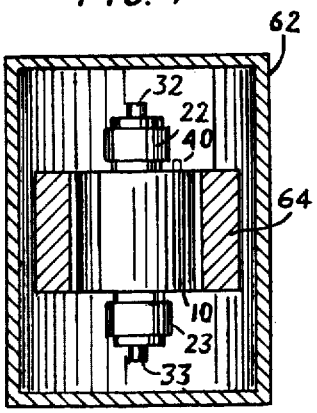
FIG. 7 is a sectional view of a heating device for heating the vacuum circuit interrupters as illustrated in FIGS. 1 through 4 in accordance with the principles of the invention with the parts illustrated in elevation.

According to another aspect of the invention, there is provided a heating device for heating the assembly of the interrupter, as previously described, for exhausting purposes. FIG. 7 shows by way of example such a device. The assembly is placed within a first heating device 62 including a gas burner or burners (not shown) for heating the entire body of the assembly. Then a second heating device 64 such as a gas burner or burners is disposed around the housing 10 to heat the housing and the associated member alone. If desired, the second heating device may be of the high frequency heating type. Alternativey, the movable contact member 35 may be brought into engagement with the stationary contact member 34 and a high current may be caused to flow therethrough to generate heat due to the contact resistance across the contact members. In any event the housing 10 and the associated members can be heated to a temperature higher than a temperature at which the components forming the insulating chambers 18 and 19 are heated by the first heating device 62. It will be appreciated that the shield members operate as previously described.

Simultaneously, the exhaust tube 40 is connected to any suitable exhausting device, as for example a vacuum pump (not shown), to exhaust the interior of the assembly until it reaches the desired degree of vacuum. Then the exhaust tube 40 disengages from the vacuum pump and is simultaneously closed in vacuum tight relationship, thus completing the vacuum circuit interrupter.

The first and second shield members 36 through 39 aid in heating the arc extinguishing chamber to a desired high temperature while the insulating chambers are maintained as a desired low temperature. The shield members serve to prevent any metallic vapor evolved in the arc extinguishing chamber 16 from entering the insulating chambers 18 and 19, and to prevent the thermal radiation originating from the arc extinguishing chamber from overheating the insulating chambers. To this end, the distances between each of the first shield members 36 and 37 and the associated contact rod 32 and 33, and between each of the first shield members and the associated second members 38 or 39, must be chosen to provide the ability to withstand voltages required for the interrupter, and must be as short as possible. Furthermore, it is more effective to dispose the first and second shield members within the arc extinguishing chamber 16. The second heating device 64 cooperates with the shield member to heat the housing and the associated members to a higher temperature, up to a rod hot condition, for a long interval of time without overheating the insulating chambers.

Figure 8:
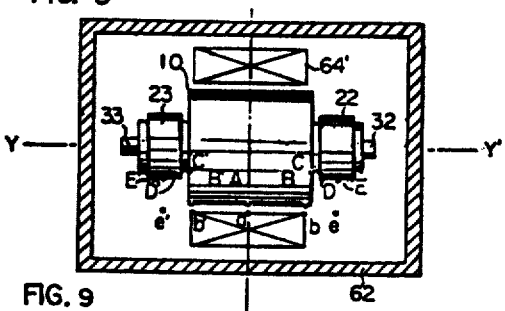
FIG. 8 is a diagrammatic view of a high frequency heating device having disposed therein the vacuum circuit interrupter shown in any of FIGS. 1 through 4 with various temperature measuring points illustrated.

As shown in FIG. 8, any of the vacuum circuit interrupters as above described can be placed in a heating winding 64, representing a high frequency heating device, and heated in a well known manner within a heating furnace 62. In an example performed with respect to this invention, thermocouples were fixed at various points A, B, C, D, E, B', C', D' and E' on the surface of the circuit interrupter, to measure temperatures thereat. Similarly temperatures at points a, b and c on the surface of the winding 64' as well as those points e and e' corresponding to the positions of the insulating chambers were measured by thermocouples.

Figure 9:
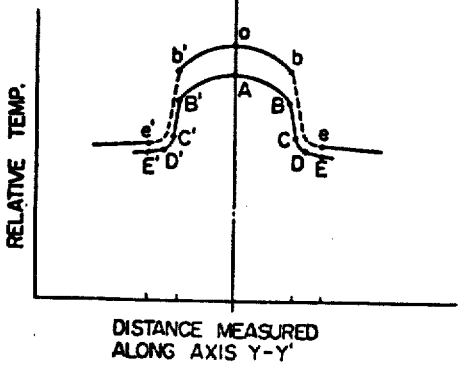
FIG. 9 is a graph illustrating the result of the measurement conducted with the heating device shown in FIG. 8.

The results of the temperature measurements are shown in the graph of FIG. 9, wherein the axis of abscissas represents a distance measured along the central axis Y'—Y' of the circuit interrupter. In FIG. 9, a temperature measured at any point is labelled the same reference character designating that point in FIG. 8. For example, a temperature labelled "A" was measured at the middle point A on the outer periphery of the housing 10, and a temperature labelled "e" was measured at the point e shown in FIG. 8 and could be considered to represent a temperature within the insulating chamber enclosed with the insulator 22.

The graph shown in FIG. 9 illustrates conclusively that during the evacuating and outgassing process, the interior of the arc-extinguishing chamber or of the housing 10 is higher in temperature than the insulating chamber.

Figure 10:
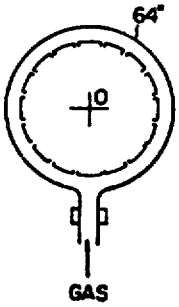
FIG. 10 is a schematic view of a burner type heating device for heating the vacuum circuit interrupters as illustrated in FIGS. 1 through 4.
Figure 11:
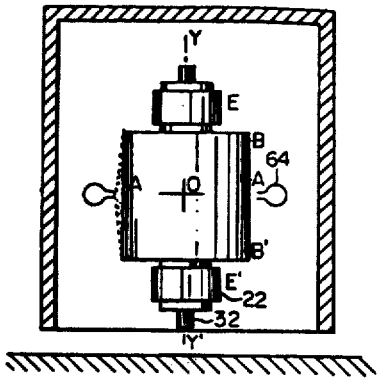
FIG. 11 is a view illustrating the manner in which the heating device shown in FIG. 10 is used to heat the vacuum circuit interrupter.

FIG. 10 shows a burner type annular heating device 64" in which a plurality of nozzles are disposed in a circle and corrected to the center of the circle. The vacuum circuit interrupter is disposed in the opening of the annular heating device so that the middle portion of the housing 10 faces the plurality of nozzles of the device 64" as shown in FIG. 10. In the arrangement of FIG. 11 a difference in temperature between the arc-extinguishing and insulating chambers can be greater than in the arrangement of FIG. 8. In operation, the heating device is controlled by an amount of fuel gas supplied to heat the middle portion A—A of the arc-extinguishing chamber or the housing 10 to a red temperature for the stainless steel involved while the temperature E or E' of each insulator 22 or 23 is maintained below a softening temperature of glass, (which approximates about 450° C.) for example. In that event only the temperatures of the insulators 22 and 23 can be conveniently measured by the respective thermocouples and the temperature of the middle portion A—A of the housing is visually determined by observing the color temperature thereof. In this way of insulating chambers are satisfactorily outgassed while they are maintained at a safe low temperature, with the arc-extinguishing chamber heated to the red temperature.

What we claim is:

1. In a vacuum circuit interrupter of the type having an evacuated housing including a metallic portion and an electrically insulative portion; at least one pair of relatively movable opposed contacts within said housing and electrically insulated from each other; and means actuatable to position said contacts relative to each other between a contacting position and separated positions; the improvement comprising:

at least one of said contacts including copper as a base metal and a second metal selected from the group consisting of bismuth, tellurium, antimony, and silver, and said second metal having a melting-point and a boiling point sufficiently lower than those of the copper base metal to inhibit fusion of the contacts during interruption of low currents; and a low magnetic permeability stainless steel shield disposed to prevent metal vapor from said contacts from being condensed on the insulative portion of said evacuated housing, and said low magnetic permeability steel having a low coefficient of adhesion with said second metal to effect a low deposition rate of vapor of said second metal from said contacts thereon.

2. A vacuum circuit interrupter according to claim 1, wherein the metallic portion of said housing comprises stainless steel.

3. A vacuum circuit interrupter according to claim 2, wherein said stainless steel is austenitic steel consisting of at least 10% by weight of chromium, at least 6% by weight of nickel, and the remainder iron except for very small amounts of incidental impurities.

4. A vacuum circuit interrupter according to claim 1, wherein the low magnetic permeability stainless steel is austenitic steel consisting of at least 10% by weight of chromium, at least 6% by weight of nickel, and the remainder iron except for very small amounts of incidental impurities.

5. In a vacuum circuit interrupter of the type having an evacuated housing including a metallic portion and an electrically insulative portion; and a pair of electrically insulated contacts within said housing and relatively movable between a contacting position and separated positions; the improvement comprising:

at least one of said contacts including a base metal and a second metal having melting point and a boiling point sufficiently lower than those of the base metal to inhibit fusion of the contacts during arcing caused by the interruption of low currents, and having a coefficient of adhesion with low magnetic permeability stainless steel low enough to substantially prevent the deposition of vapor of said second metal developed during arcing onto low magnetic permeability stainless steel within said housing; and a low magnetic permeability stainless steel shield disposed to prevent metal vapor from said contacts from being condensed on the insulative portion of said housing, and formed of said stainless steel to substantially prevent the deposition of said vapor of said second metal on said shield.

6. In a vacuum circuit interrupter according to claim 5, wherein said second metal is selected from the group consisting of bismuth, tellurium, antimony and silver.

7. In a vacuum circuit interrupter according to claim 5, wherein said low magnetic permeability stainless steel is austenitic steel consisting of at least 10% by weight of chromium, at least 6% by weight of nickel, and the remainder iron except for very small amounts of incidental impurities.

8. In a vacuum circuit interrupter according to claim 5, wherein the metallic portion of said housing is stainless steel.

9. In a vacuum circuit interrupter according to claim 8, wherein stainless steel is austenitic steel consisting of at least 10% by weight of chromium, at least 6% by weight of nickel, and the remainder iron except for very small amounts of incidental impurities.

* * * * *